US008522412B1

(12) United States Patent
Walker

(10) Patent No.: US 8,522,412 B1
(45) Date of Patent: Sep. 3, 2013

(54) EXTRACTION TOOL LIFTING SYSTEM

(75) Inventor: William A. Walker, Butler, OH (US)

(73) Assignee: Line Walker, LLC, Butler, OH (US)

( * ) Notice: Subject to any disclaimer, the term of this patent is extended or adjusted under 35 U.S.C. 154(b) by 410 days.

(21) Appl. No.: 12/818,107

(22) Filed: Jun. 17, 2010

Related U.S. Application Data

(63) Continuation-in-part of application No. 12/705,590, filed on Feb. 13, 2010, now Pat. No. 8,376,678, which is a continuation of application No. 11/734,215, filed on Apr. 11, 2007, now Pat. No. 7,686,359, and a continuation-in-part of application No. 11/395,659, filed on Apr. 3, 2006, now abandoned.

(60) Provisional application No. 61/187,722, filed on Jun. 17, 2009.

(51) Int. Cl.
*B66F 3/00* (2006.01)
*B66F 19/00* (2006.01)

(52) U.S. Cl.
USPC ..... 29/255; 254/30; 254/133 R; 254/199; 254/264; 408/199; 411/387.1; 29/244; 29/252; 29/270; 29/278

(58) Field of Classification Search
USPC .. 29/255, 244, 252, 270, 278; 254/134.3 PA, 254/199, 227, 245, 263, 30, 264, 338, 133 R, 254/134; 408/199; 411/387.1
See application file for complete search history.

(56) References Cited

U.S. PATENT DOCUMENTS 82,484 A * 9/1868 Booth ..... 254/227
196,811 A * 11/1877 Kirkwood ..... 254/95
215,720 A * 5/1879 Chapman ..... 254/132
226,884 A * 4/1880 Schmaly ..... 254/228
236,829 A * 1/1881 Merchant ..... 254/214
277,484 A * 5/1883 Hawes ..... 254/263
378,500 A * 2/1888 Gallup ..... 254/336
468,644 A * 2/1892 Cornelius ..... 254/296
772,994 A * 10/1904 Wood ..... 254/338
914,920 A * 3/1909 Bradley ..... 254/214
988,762 A * 4/1911 Emanuel ..... 254/30
1,006,336 A * 10/1911 Yeo ..... 254/219
1,021,922 A * 4/1912 Ellson ..... 254/242
1,057,492 A * 4/1913 Munzinger ..... 408/113
1,111,784 A * 9/1914 Blackburn ..... 254/242
1,194,214 A * 8/1916 Morris et al. ..... 254/93 R
1,214,104 A * 1/1917 Wingire ..... 254/334
1,215,874 A * 2/1917 Scherrer ..... 254/338
1,553,692 A * 9/1925 Huckle ..... 254/242
1,577,439 A * 3/1926 Armbruster ..... 254/214
1,909,696 A * 5/1933 List ..... 254/30
2,102,985 A * 12/1937 Wadel ..... 601/133
(Continued)

*Primary Examiner* — Basil Katcheves
*Assistant Examiner* — Rodney Mintz
(74) *Attorney, Agent, or Firm* — Ronald J. Koch

(57) ABSTRACT

An extraction tool lifting apparatus having a load bearing coupling capable of being removably connected to an extraction tool; an hydraulic cylinder assembly being operatively connected at a first end to the load bearing coupling; a mounting bracket being operatively connected to the second end of the hydraulic cylinder assembly; three legs, each operatively connected at a first end to the mounting bracket; the load bearing coupling being adapted to be removably connected to an extraction tool having, an elongated base member having first and second ends, and a drill bit being removably attachable to a socket in the first end, the base member having a threaded portion being disposed approximate the first end, the second end being adapted to be removably connected to the load bearing coupling.

8 Claims, 8 Drawing Sheets

(56) References Cited

U.S. PATENT DOCUMENTS

| | | | | | |
|---|---|---|---|---|---|
| 2,327,180 | A | * | 8/1943 | Diercksmeier et al. | 254/1 |
| 2,376,676 | A | * | 5/1945 | Ferguson | 254/30 |
| 2,484,400 | A | * | 10/1949 | Brown | 29/283 |
| 2,566,847 | A | * | 9/1951 | Miller | 29/252 |
| 2,715,261 | A | * | 8/1955 | Williams | 29/252 |
| 3,087,236 | A | * | 4/1963 | Paytas | 29/244 |
| 3,180,617 | A | * | 4/1965 | Brown | 254/30 |
| 3,269,704 | A | * | 8/1966 | Pfundt | 254/30 |
| 3,526,387 | A | * | 9/1970 | Fleming | 254/30 |
| 3,576,311 | A | * | 4/1971 | Cartner | 254/30 |
| 3,647,185 | A | * | 3/1972 | Phibbs | 254/30 |
| 3,880,604 | A | * | 4/1975 | Hawkins | 29/252 |
| 3,920,212 | A | * | 11/1975 | Westwood | 248/346.01 |
| 3,948,484 | A | * | 4/1976 | Tesinsky | 254/134 |
| 4,469,307 | A | * | 9/1984 | Bell | 254/199 |
| 4,670,958 | A | * | 6/1987 | Hoffgen | 29/252 |
| 4,707,900 | A | * | 11/1987 | Twogood et al. | 29/244 |
| 4,860,404 | A | * | 8/1989 | Flachs | 452/187 |
| 4,893,783 | A | * | 1/1990 | Diener et al. | 254/1 |
| 5,054,744 | A | * | 10/1991 | Essex | 254/228 |
| 5,233,740 | A | * | 8/1993 | Chen | 29/252 |
| 5,417,406 | A | * | 5/1995 | Fanchier, Jr. | 254/199 |
| 5,673,804 | A | * | 10/1997 | Weiss et al. | 212/274 |
| 6,257,555 | B1 | * | 7/2001 | Barbara | 254/264 |
| 6,531,992 | B1 | * | 3/2003 | Ehrenberg et al. | 343/912 |
| 6,895,646 | B1 | * | 5/2005 | Houg | 29/252 |
| 6,951,326 | B2 | * | 10/2005 | Vanover | 248/170 |
| 7,137,616 | B2 | * | 11/2006 | Kysely | 254/30 |
| 7,686,359 | B1 | * | 3/2010 | Walker | 408/199 |
| 7,966,740 | B2 | * | 6/2011 | Knudsen | 33/613 |
| 7,996,972 | B2 | * | 8/2011 | Hu | 29/252 |
| 8,376,678 | B2 | * | 2/2013 | Walker | 411/387.1 |
| 2002/0135531 | A1 | * | 9/2002 | Ehrenberg et al. | 343/878 |
| 2003/0107525 | A1 | * | 6/2003 | Ehrenberg et al. | 343/881 |
| 2007/0231106 | A1 | * | 10/2007 | Walker | 411/401 |
| 2008/0237415 | A1 | * | 10/2008 | Michalec | 248/157 |
| 2010/0005661 | A1 | * | 1/2010 | Sorensen | 29/897.1 |
| 2010/0156123 | A1 | * | 6/2010 | Walker | 294/1.1 |
| 2010/0258772 | A1 | * | 10/2010 | Parkin | 254/29 A |
| 2012/0138594 | A1 | * | 6/2012 | Stewart | 219/429 |
| 2013/0069025 | A1 | * | 3/2013 | Schooley | 254/30 |

* cited by examiner

EXTRACTION TOOL LIFTING SYSTEM

BACKGROUND AND SUMMARY

The present invention relates generally to electrical utility linework and specifically to the removal of utility poles from the ground. Since the inception of power and telephone poles very little innovation or new technologies have been introduced to remove these units once decayed or broken off due to hurricanes, accidents and/or other forces.

Lineman (utility workers for power companies, etc.) have struggled to remove power poles. Many times, having to excavate around these poles in order to use a choker chain or improvised means (e.g. a ground rod driven into the pole and clamped onto and removed with a line truck—subjecting the line truck to unnecessary risk of damage). The present invention overcomes these limitations, as well as provides other objects and advantages that will be apparent to one of skill in the art.

In one embodiment, the present invention adapts to a Kelly bar on line trucks (known in the art) thus enabling the lineman to drill into a pole, post, stump, etc, thereby anchoring the tool head into whatever item is to be removed. The extraction apparatus is then secured to the tool and the pole is removed by hydraulic pressure. Doing so presents a useful alternative to using the boom of the line truck to attach to the tool for removal in that many utilities disfavor using the boom for such removal.

In one embodiment, the invention includes means to affix a mounting bracket and hydraulic cylinder atop of a base member; the bracket having three telescoping legs extending therefrom which engage the ground; thereafter, the cylinder is used to apply force to the base member to apply upward force to the base member to dislodge the pole. The present invention is advantageous because one man can now perform a task once requiring multiple persons. This results in saving time and money while providing safety for the lineman.

The Present invention is primarily designed for removal of broken poles at or below ground level. It is generally used in conjunction with a line truck (a.k.a. "digger truck"). The truck can be replaced with mobile or stand alone systems (a.k.a. "backyard machines"). Generally, the invention in one embodiment is practiced as follows:

Be sure the outriggers are down and grounds are out. Unrack the boom and auger (use 18 inch auger). Remove the auger off of the Kelly Bar. Install the AB Chance adapter (this adapter is the same one that is used to screw in triple helix anchors).

Pin the base member into the AB chance adapter. One end of the adapter fits into the Kelly Bar and the other end fits onto the Base member. Swing the boom of the truck with the Base member attached over top of the pole that is to be removed from the ground. Position the tip of the Base member such that the drill bit is positioned at or near the center of the pole.

Screw the Base member into the broken pole by rotating the load line of the boom with the line truck until the full length of the threads are within the wood. Note that it may be necessary to go even deeper depending on the condition of the wood.

After the threads engage the wood (also the drill bit) and while rotating, make sure to apply downward pressure as needed to insure the base member is always moving into the wood. Do not allow the base member to rotate without moving downward.

Once the Base member is fully inserted, unpin the AB Chance Adapter and relocate the boom to a safe location. Attach the cylinder to the top of the base member and insert the pin and clip to hold it in place. Then attach the triangular (a.k.a. delta) support bracket onto the top of the cylinder using the pin and retaining clip. Then attach the hydraulic lines from the line truck to the quick release disconnects on the cylinder and use the hydraulics to fully extend the piston so as to raise the cylinder.

Then attach the 3 legs to the triangular support bracket using the pins and retaining clips. Then extend the legs downward to make contact with the ground. Ensure that the legs are extended outward to tighten the retaining harness (i.e. "chain"). At this point the assembly is ready to make the first pull. Stand clear of the assembly at a safe distance and engage the hydraulic pressure so as to raise the pole out of the ground.

After the pole is raised with the cylinder and the cylinder is fully compressed (refracted), repeat the process to continue removing the pole by raising the cylinder so the piston is fully extended, lowering the legs, and making the next pull, etc. Continue this until the pole is far enough out of the ground so that it can be fully removed with the boom of the line truck and choker chain (or cable sling, etc.) However, it is best to not remove the pole from the ground until the base member is removed from the pole.

After the pole is removed far enough to be extracted with the boom, disengage the base member from the pole jack by removing the pin and retaining clip. The jack assembly can either be relocated while assembled or disassembled and relocated. At this point the base member is still embedded in the pole.

Remove the base member from the pole by reattaching it to the Kelly Bar with the AB Chance adapter. Then rotate the load line of the boom with the line truck until the base member is fully removed. Then use a choker chain (or cable sling) and boom to remove the pole from the ground. The pulling eye adapter can also be used to remove the base member from the pole in the event the pole is removed from the ground prior to the base member being removed. To do this, use one or two can hooks and a large pry bar to manually unscrew the base member.

REFERENCE NUMERALS IN DRAWINGS

Figure 1:
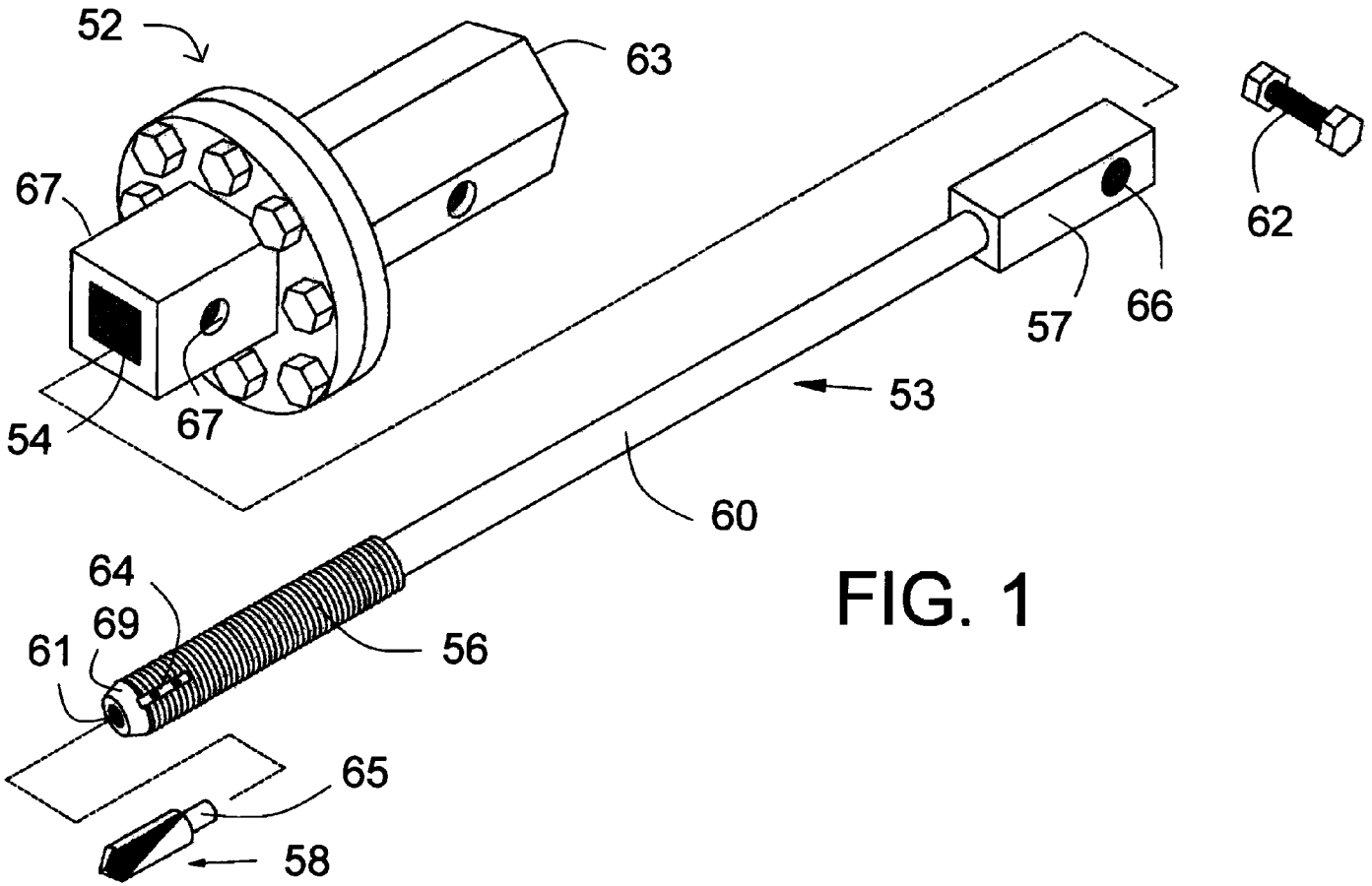
FIG. 1 depicts a perspective, exploded view of base member 53 and kelly bar assembly 52 of one embodiment of the present invention

The table below lists the reference numerals employed in the figures, and identifies the element designated by each numeral.

52 kelly bar assembly 52
53 base member 53
54 drive tool adapter 54
55 extraction tool adapter 55
56 threaded portion 56
57 squared head portion 57
58 drill bit 58
59 handle 59 of extraction coupling
60 middle portion 60 of base member
61 drill bit socket 61
62 adapter fastener 62
63 Kelly Bar Adapter 63
64 drill bit fasteners 64
65 drill bit coupling stem 65
66 adapter socket 66
67 drive tool fastener holes 67
68 extraction tool fastener holes 68
69 conical transition bit mounting foot 69
70 extraction coupling 70
74 upper end 74 of extraction coupling
100 leg 100
110 leg second portion 110
111 leg first portion 111
112 leg holes 112
113 leg first end 113
114 leg second end 114
115 leg mounting holes 115
116 support pads 116
117 leg retention band 117
120 hydraulic cylinder assembly 120
121 load bearing coupling 121
122 first end 122 of hydraulic cylinder assembly
123 second end 123 of hydraulic cylinder assembly
124 connection aperture 124 of load bearing coupling
125 vertical mounting lobes 125 of hydraulic cylinder assembly
126 aperture 126 of vertical mounting lobes
130 mounting bracket 130
131 end-truncated triangular shaped base member (a.k.a. triangular base member) 131 of mounting bracket
132 elongated aperture 132 of triangular base member
133 vertical support member 133 of mounting bracket
134 aperture 134 of vertical support member of mounting bracket
135 mounting pin 135
52A kelly bar assembly 52A
53A base member 53A
54A drive tool adapter 54A
55A extraction tool adapter 55A
56A first threaded portion 56A
57A squared head portion 57A
58A drill bit 58A
59A handle 59A of extraction coupling
60A middle portion 60A of base member
61A drill bit socket 61A
62A adapter fastener 62A
63A Kelly Bar Adapter 63A
64A drill bit fasteners 64A
65A drill bit coupling stem 65A
66A adapter socket 66A
67A drive tool fastener holes 67A
68A extraction tool fastener holes 68A
69A conical transition bit mounting foot 69A
70A extraction coupling 70A
74A upper end 74A of extraction coupling
75A second threaded portion 75A

DETAILED DESCRIPTION

In one embodiment, an extraction tool comprises: an elongated base member 53A having first and second ends 69A, 57A; and a drill bit 58A being removably attachable to a socket 61A in the first end.

Base member 53A has a first threaded portion 56A that is disposed approximate the first end and a second threaded portion 75A that is disposed approximate the first end between the first threaded portion 56A and the second end of the base member.

Second threaded portion 75A has an outer diameter greater than the outer diameter of first threaded portion 56A. This facilitates the threaded portions gripping, or digging, into the wood as the tool is screwed therein. Second end 57A is adapted to be removably connected to a load bearing coupling. In one embodiment, elongated base member 53A is made of 4140 grade steel, and made from a unitary piece of stock to promote extra strength characteristics.

Drill bit 58A is inserted into a socket 61A in the first end and secured by screws (e.g. threaded allen head screws) 64A or the equivalent. The load bearing coupling can be either a kelly bar adapter 52 (a.k.a. Kelly bar assembly) for use with the boom of a line truck; an extraction ring 70 (a.k.a. extraction coupling), having a first end 55 adapted to be removably connected to the second end 57 (a.k.a. squared head portion) of base member 53 and a second end 59 essentially having a ring shape, for use with a line truck or other pulling or rotating means; or load bearing coupling 121 having a rectangular cross section (a.k.a. a "squared portion") and a connection aperture 123 (aligned with adapter socket 66 when assembled) through which a pin can be inserted. Kelly bars and Kelly bar adapters (a.k.a. AB chance adapters) are known. They are removably connectable to the boom of a line truck.

Figure 1A:
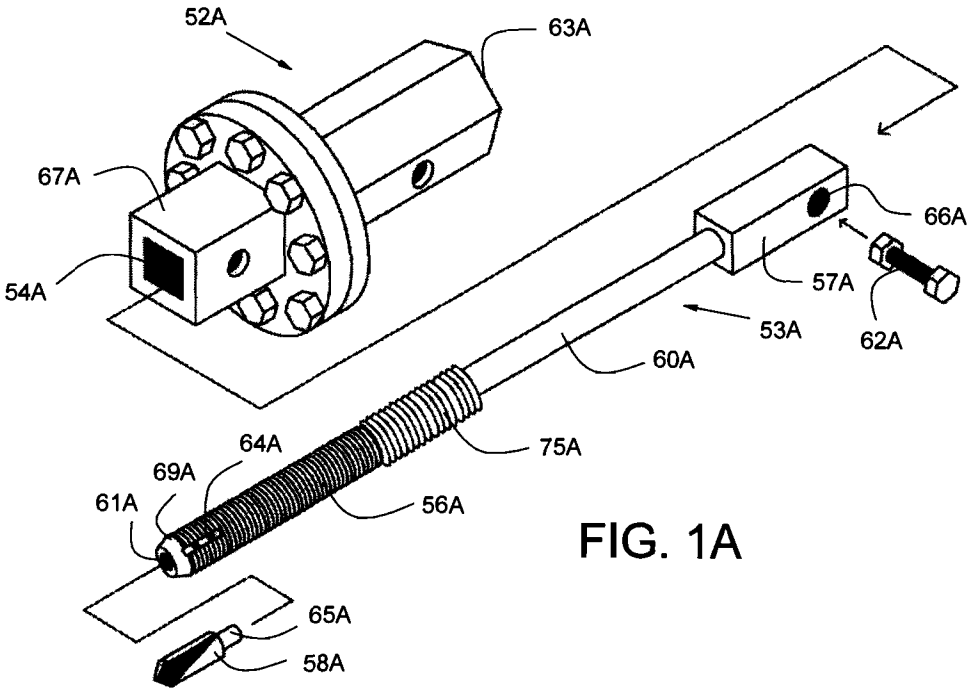
FIG. 1A depicts a perspective, exploded view of base member 53A and kelly bar assembly 52A of one embodiment of the present invention
Figure 2:
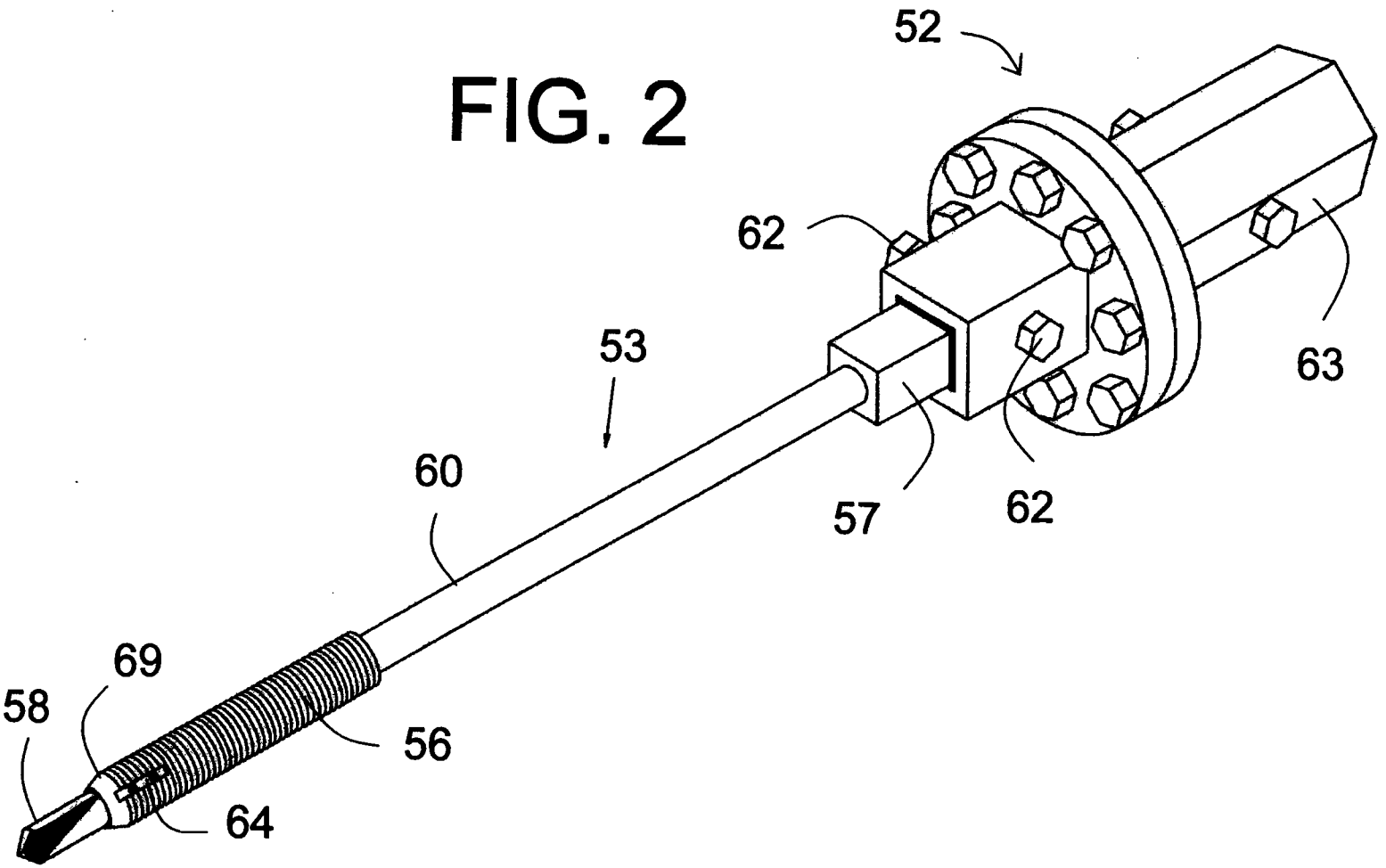
FIG. 2 depicts a perspective view of base member 53 and kelly bar assembly 52 of one embodiment of the present invention
Figure 3:
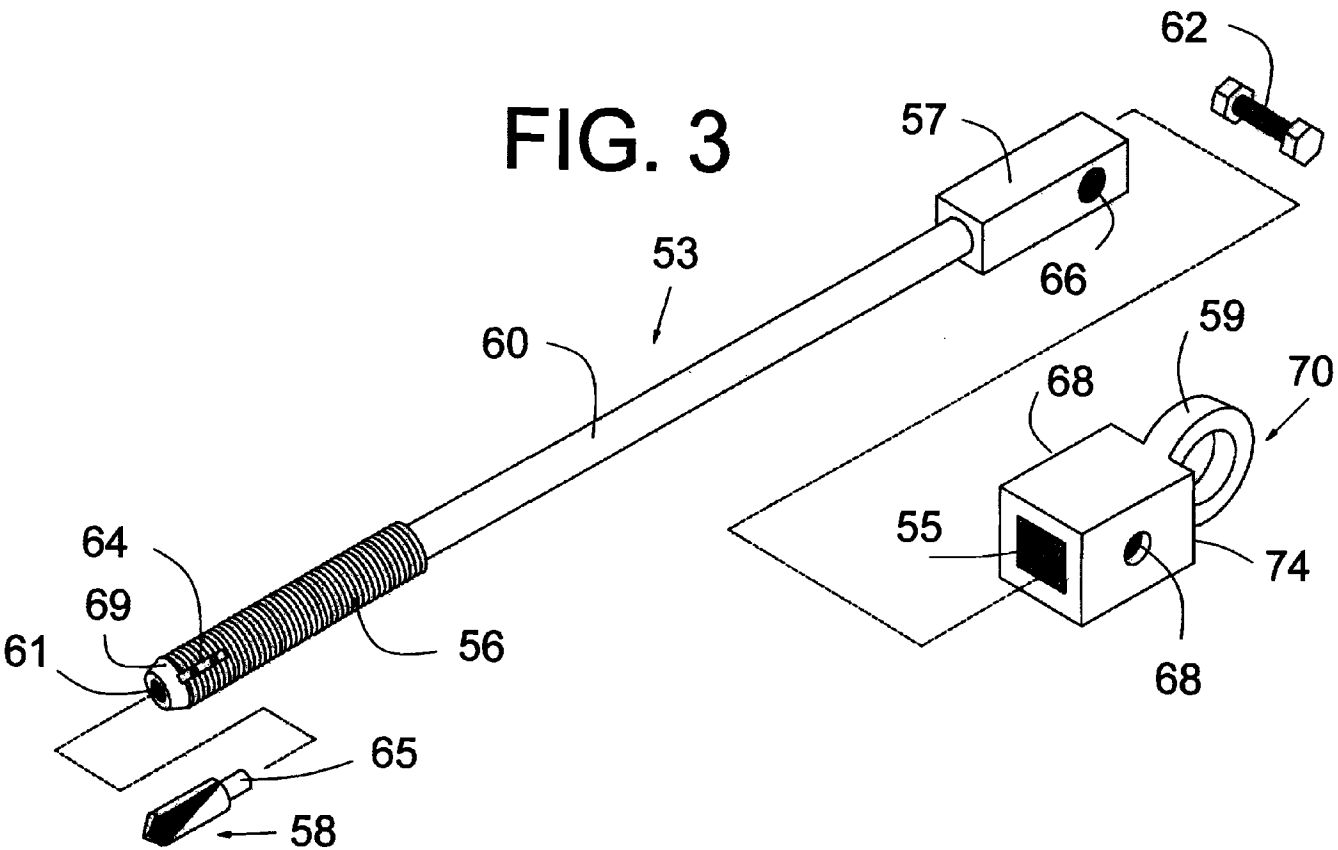
FIG. 3 depicts a perspective, exploded view of base member 53 and extraction coupling 70 of one embodiment of the present invention
Figure 4:
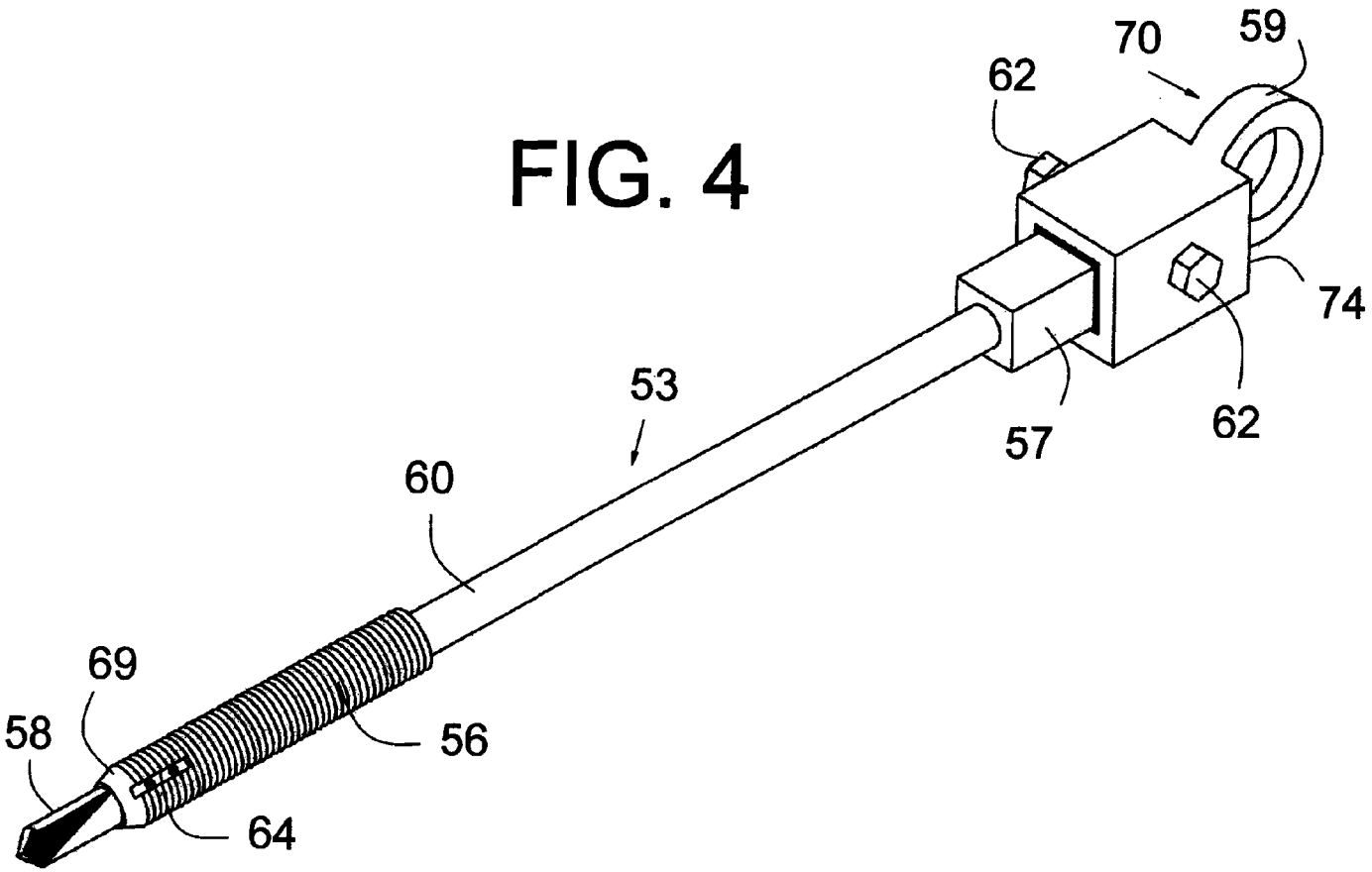
FIG. 4 depicts a perspective view of base member 53 and extraction coupling 70 of one embodiment of the present invention
Figure 5:
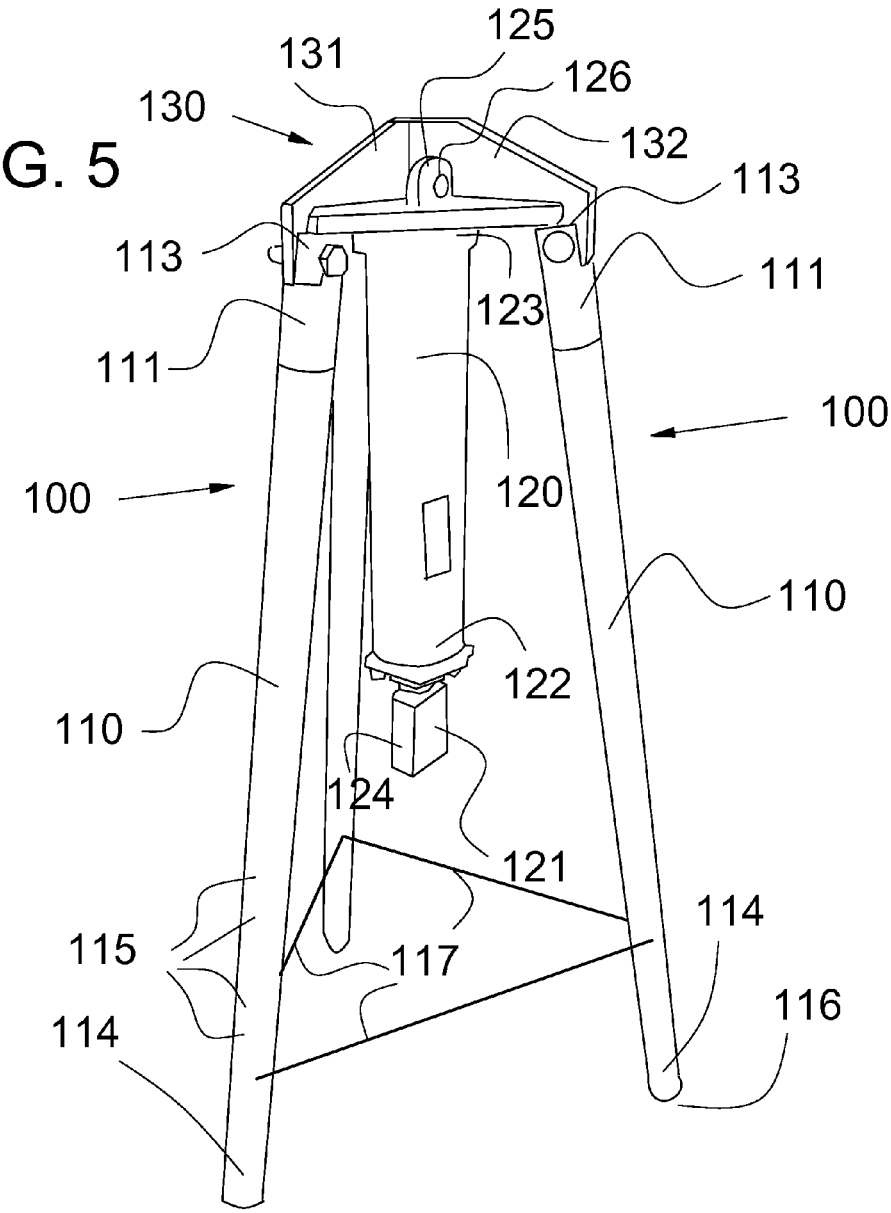
FIG. 5 depicts a perspective view of one embodiment of the extraction tool lifting apparatus of the present invention
Figure 6:
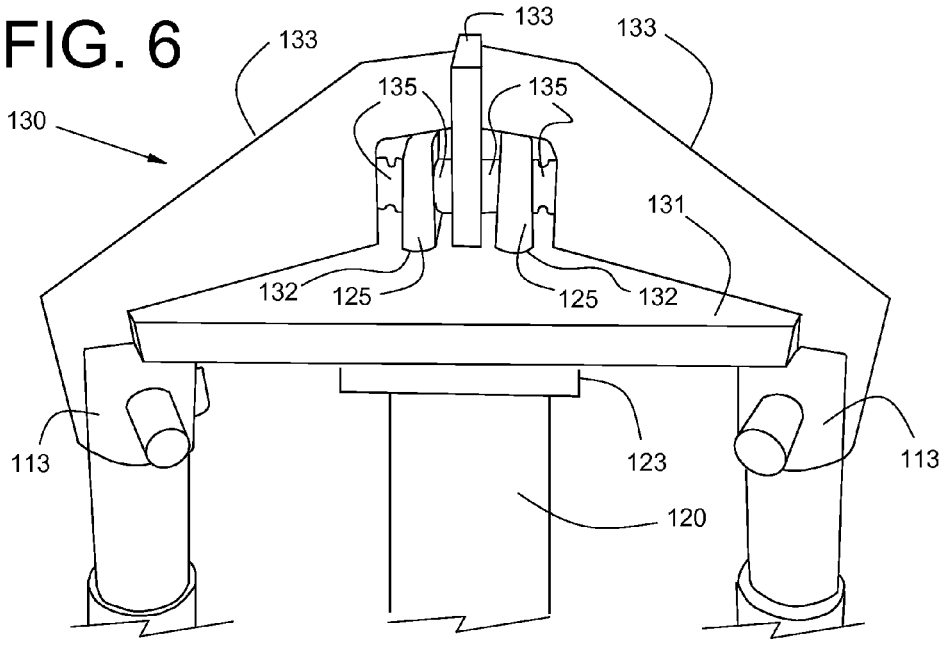
FIG. 6 depicts a perspective view of one embodiment of the mounting bracket 130 of the present invention

Other than second threaded portion 75A, base member 53A (depicted in FIG. 1A) is essentially the same as base member 53 (FIG. 1), and likewise for the relationships depicted in FIGS. 2 through 4.

In one embodiment, first and second threaded portions 56A & 75A have outer diameters of 2 & 2.5 inches, respectively and are 13 and 10 inches long, respectively. Both portions incorporate a 60 degree angle thread, 4 threads per inch.

In one embodiment (FIGS. 1 through 4), second end 57 (a.k.a. squared head portion) transitions to a middle portion 60 which is 2.0 inches in diameter. Middle portion 60 transitions to a threaded portion 56, that is 2½"-4 UNC male-threaded rod and 12.0 inches in length. Various thread sizes may be used. It is preferred that the thread used is aggressive, so as to facilitate drilling through wood, etc.

In one embodiment, an extraction tool lifting apparatus comprises: a load bearing coupling 121 capable of being removably connected to an extraction tool (for example, the tool as depicted in FIG. 1A, or FIGS. 1 through 4); an hydraulic cylinder assembly 120 being operatively connected at a first end 122 to load bearing coupling 121; a mounting bracket 130 being operatively connected to the second end 123 of the hydraulic cylinder assembly 120; and three legs 100, each operatively connected at a first end 113 to the mounting bracket 130; whereby the extraction tool lifting apparatus can be removably connected to an extraction tool for removal of an object embedded within a confinement (e.g. a wooden utility pole embedded within the ground); further whereby the extraction tool lifting apparatus can be disassembled when not in use.

Hydraulic cylinder assembly 120 (known in the art) has two hydraulic hose couplings (not shown) whereby hydraulic force can be exerted to cause the cylinder to forcefully extend outward, or retract inward. The present invention utilizes the latter to extract poles from the ground and the former to prepare the cylinder for a pull by extending it.

In one embodiment, hydraulic cylinder assembly 120 has an 18 inch stroke and 3 inch bore (other combinations can be used), and is rated at 3,000 psi. Legs 100 are pivotably and removably secured to mounting bracket 130 so they can be extended outward and removed for storage or transportation. Load bearing coupling 121 is adapted to be removably connected to an extraction tool (e.g. that depicted in either FIG. 1 or 1A). Second end 123 of hydraulic cylinder assembly 120 has 2 vertical mounting lobes 125, spaced laterally apart, each with an aperture 126, that are coaxial with each other.

Figure 7:
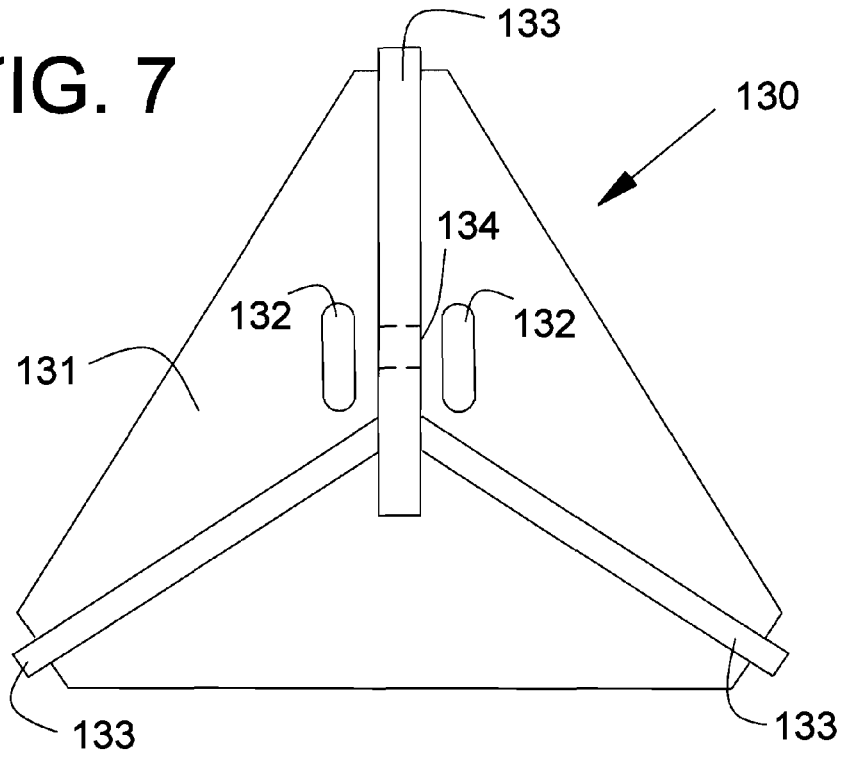
FIG. 7 depicts a plan view the triangular base member 131

Mounting bracket 130 comprises end-truncated triangular shaped base member 131 (a.k.a. triangular base member) and three vertical support members 133 attached to triangular base member 131 essentially at 120 degrees apart with respect to each other (FIG. 7).

Triangular base member 131 has two elongated apertures 132 for receiving the 2 mounting lobes 125 of hydraulic cylinder assembly 120, the mounting lobes extending through the apertures 132 when assembled.

One of the three vertical support members 133 has an aperture 134 adapted to be collinear with the apertures 126 of the 2 mounting lobes 125 of hydraulic cylinder assembly 120 (fitting within the elongated apertures 132 of triangular base member 131) whereby a pin 135 can be extended through the 3 apertures so as to removably attach the mounting bracket 130 to the hydraulic cylinder assembly 120.

In one embodiment, legs 100 are telescoping to facilitate a greater latitude of vertical movement and horizontal positioning of the apparatus. Each of the three legs has cooperating first and second portions 111, 110 so as to be adjustable among a plurality of lengths. Both leg portions have mounting holes 115 that line up with each other so the legs may be adjusted and a pin inserted therein to lock the leg in place.

In one embodiment, legs 100 have support pads 116 pivotably connected to the second end 114 of each leg. The pads are connected with an orbital joint or the like to achieve 3 dimensional rotation to facilitate differing ground contours. The pads are round and flat to prevent legs 100 from sinking into the ground and to facilitate a secure footing.

In one embodiment, legs 100 have restraining means (a.k.a. leg retention band) operatively connected to all of the legs approximate the second ends 114 thereof to prevent over extension of the legs resulting in collapse or insecurity of the apparatus. The restraining means can be chain, cable, or rope, or any similar material. Each leg is comprised of (2) 4 ft pieces of round tubing arranged in a telescoping way. There are multiple mounting holes (a.k.a. leg holes) in each leg, at 3 in increments. Each tube has approximately ⅛ in wall thickness and the outer diameters are sized to allow a cooperating fit with the transitional outer diameter being approximately 1.75 in.

As shown in FIGS. 1 through 4, one embodiment of the extraction tool utilized with the extraction tool lifting apparatus comprises base member 53 having squared head portion 57, adapter socket 66, cylindrical middle portion 60, threaded portion 56, conical transition bit mounting foot 69, drill bit socket 61, drill bit 58, and a plurality of drill bit fasteners 64; Kelly bar assembly 52 having drive tool adapter 54, drive tool fastener holes 67, and Kelly Bar Adapter 63; and extraction coupling 70 having extraction tool adapter 55, and handle 59.

Extraction tool fastener holes 68 are displaced on opposite sides of extraction coupling 70. Extraction coupling 70 has an upper end 74. Base member 53 works in conjunction with either kelly bar assembly 52 or extraction coupling 70. Kelly Bar Adapter 63, is attached by bolted flange to drive tool adapter 54, which has two drive tool fastener holes 67.

In one embodiment, base member 53 is formed of solid steel stock (e.g. 4140 alloy steel) for optimum rigidity and torque resistance, and is preferably 36.0 inches in length. However, other lengths may be used; as will be appreciated by those of skill in the art, the spirit of the invention comprises removal of rigid bodies from the ground; therefore, the overall length of base member 53 may be varied accordingly.

In one embodiment, squared head portion 57 has a cross section of essentially 1.6 inches by 1.6 inches outside dimension and is essentially 5.0 inches in length. Squared head portion 57 has an adapter socket 66 (essentially 0.80 inches in diameter), located to enable releasable attachment to either drive tool adapter 54 or extraction tool adapter 55 by adapter fastener 62. Squared head portion 57 transitions to a middle portion 60 which is essentially 2.0 inches in diameter. Middle portion 60 transitions to a threaded portion 56, that is essentially a 2½"-4 UNC male-threaded rod and essentially 12.0 inches in length.

Threaded portion 56 uses a sixty degree thread, four threads per inch, with an outer diameter of two inches. As will be apparent, various thread sizes may be used. It is preferred that the thread used is aggressive, so as to facilitate drilling through wood, etc.

Threaded portion 56 transitions to conical transition bit mounting foot 69 and is essentially tapered from 2.0 inches in diameter to 1.38 inches in diameter. Conical transition bit mounting foot 69 is designed to help prevent binding, and burning, and it makes for easier removal of drill bit 58.

Bit mounting foot 69 has a centrally located drill bit socket 61 and a plurality of drill bit fasteners 64. The embodiment depicted comprises 2 drill bit fasteners. However, other quantities may be used provided the spirit of the invention is not compromised.

Drill bit socket 61 is essentially 0.875 inches in diameter and 2.5 inches in length, and fabricated to accommodate the mounting of drill bit coupling stem 65 of drill bit 58.

Drill bit 58 is essentially made of steel and 1.5 inches in diameter and 4.5 inches in length. Drill bit 58 has a drill bit coupling stem 65 that is essentially cylindrical (so as to allow it to fit within drill bit socket 61), and essentially 0.75 inches in diameter and 2.25 inches in length.

Drill bit fasteners 64 are preferably stainless steel Allen screw sets of a predetermined size sufficient to secure drill bit coupling stem 65.

Kelly Bar Adapter 63, is attached by bolted flange to a drive tool adapter 54, which has two drive tool fastener holes 67. Drive tool adapter 54 is capable of releasable attachment to squared head portion 57 of base member 53. Drive tool fastener holes 67, located one on each of parallel opposite sides, are to be aligned with adapter socket 66, and are preferably 0.80 inches in diameter. Drive tool adapter 54 has an inner recessed portion of rectangular cross section having dimensions of approximately 1.725 inches by 1.725 inches whereby squared head portion 57 is capable of fitting within.

Extraction coupling 70 is made capable of releasable attachment to squared head portion 57 of base member 53, and comprises extraction tool adapter 55, handle 59, and extraction tool fastener holes 68. Extraction coupling 70 is preferably made of steel and 8.0 inches in length.

Extraction tool adapter 55 is of sufficient thickness to provide sufficient rigidity and strength as required for the extraction of rigid bodies. It is preferably 4.0 inches in length, and has an outer cross section of 2.13 inches by 2.13 inches. Extraction tool adapter 55 has an inner recessed portion of rectangular cross section having dimensions of 1.725 inches by 1.725 inches whereby squared head portion 57 is capable of fitting within.

Extraction tool fastener holes 68, located one on each of parallel opposite sides, are to be aligned with adapter socket 66, and are preferably 0.80 inches in diameter.

Handle 59 is preferably welded onto upper end 74 of extraction coupling 70, and 4.0 inches outer diameter and 0.50 inches thick. Handle 59 is made to provide sufficient rigidity and strength as required for extraction of the rigid body. The shape is such to allow for the hook shaped member of a winch system to be attached to handle 59 for extraction of the rigid body. The shape is also such to allow a worker to manually turn the handle to unscrew and disengage base member 53 (in combination with extraction coupling 70) from the rigid body.

The primary purpose of drive tool adapter 54 and extraction tool adapter 55 is to accommodate squared head portion 57. Therefore, as will be apparent, the shapes thereof may be deviated from provided said primary purpose is not compromised.

Threaded adapter fastener 62 is preferably a common ⅝ inches diameter steel bolt with nut and lock washer, or a common ⅝ inches diameter steel belt-arm retaining pin with coil lock. Threaded adapter fastener 62 is preferably 0.7375 inches outer diameter and capable of fitting within adapter socket 66, and within either drive tool fastener holes 67 or extraction tool fastener holes 68.

It is preferred that conical transition bit mounting foot 69, threaded portion 56, middle portion 60 of base member 53, and squared head portion 57 be made from one piece of metal. This can be accomplished utilizing various known machining techniques. The invention as a whole is stronger in terms of its ability to withstand various forces, stresses, and tensions when made in this manner. However, other techniques may be used. The various parts of the invention can originate as separate pieces being joined together. Various means of joining, such as welding, can be used provided the invention maintains sufficient strength.

The embodiment depicted comprises squared head portion 57 having larger cross-sectional dimensions than the diameter of middle portion 60 of base member 53. This is not essential. In fact, if the invention is machined out of one piece of metal, squared head portion 57 will have smaller cross-sectional dimensions. The foregoing designs may be used provided squared head portion 57 can fit within drive tool adapter 54 and extraction tool adapter 55. Thus the radius of middle portion 60 of base member can be varied to achieve the foregoing.

As will be appreciated, the purpose of the present invention is to be embedded within another object and extract it upon being pulled. Accordingly, it will be apparent that middle portion 60 of base member 53 does not have to have circular cross section. It can have any shape provided the structural integrity is not compromised.

As will be appreciated, the present invention is intended to be used with pre-existing kelly bar assembly 52. Accordingly, as will be obvious, these pre-existing elements can be found in various sizes and squared head portion 57 and extraction coupling 70 can be varied in size to accommodate such variations.

It is preferred that drill bit 58 not be specially made but of the off-the-shelf variety. Accordingly, the sizes of drill bit coupling stem 65 and drill bit socket 61 may be varied as needed. It is preferred that drill bit 58 be sized so as to facilitate the insertion of the threaded portion 56 into a rigid body (e.g. wooden pole). An oversized drill bit will prevent the threads from digging in.

In operation, the user first attaches drill bit 58 to base member 53. Drill bit coupling stem 65 of drill bit 58 is capable of releasable attachment to drill bit socket 61, and is secured by drill bit fasteners 64. Next, kelly bar assembly 52 is attached to squared head portion 57 of base member 53, and secured by inserting adapter fastener 62 through drive tool fastener holes 67 and adapter socket 66.

Kelly Bar Adapter 63 is then connected to the matching Kelly Bar of a drive system. Drill bit 58 of the tool is then positioned centrally in the exposed end of a rigid body that requires removal from the ground or from the water. The drive is engaged to transfer rotational and downward force through base member 53 and drill bit 58 to enable the improved extraction tool to be inserted within the rigid body to a predetermined length. Threaded portion 56 of base member 53 thereby engages and secures the rigid body for removal. The drive with Kelly Bar is then disengaged from Kelly Bar Adapter 63. Adapter fastener 62 is removed, and kelly bar assembly 52 is detached from squared head portion 57.

At this point, load bearing coupling 121 of hydraulic cylinder assembly 120 is attached to squared head portion 57A with a retention pin. Mounting bracket 130 is attached to second end 123 of hydraulic cylinder assembly 120. Legs 100 are then attached to mounting bracket 130. Cylinder 120 is energized to extend to piston outward, the telescoping legs are lowered into position, then hydraulic pressure is applied to retract cylinder 120 thus exerting upward force on the embedded object.

As will be apparent, base member 53 could be modified such that drill bit 58 is not separate but part of the base member. Although possible, this embodiment is not preferred.

As will be apparent, the present invention can achieved by assembling various parts or by machining one part to have the necessary shapes using means and/or methods known in the art to achieve the spirit of the invention. The spirit of this invention comprises using a first rigid body (e.g. a base member) to bore within a second rigid body (e.g. a wooden pole) embedded within a confinement (e.g. the ground), the first rigid body is pulled thus pulling the second rigid body from the confinement, and then removing the first rigid body from the second rigid body.

What is claimed is:

1. A system, comprising:

an extraction tool having:

an elongated base member having first and second ends, a drill bit removably attachable to a socket in the first end, the elongated base member having a threaded portion disposed proximate the first end, the second end adapted to be removably connected to a load bearing coupling; and an extraction tool lifting apparatus having:

the load bearing coupling removably connected to the extraction tool;

a hydraulic cylinder assembly operatively connected at a first end to the load bearing coupling;

a mounting bracket operatively connected to a second end of the hydraulic cylinder assembly;

three legs, each leg operatively connected at a first end to the mounting bracket;

the second end of the hydraulic cylinder assembly having two vertical mounting lobes, spaced laterally apart, each with an aperture, the apertures being coaxial;

an end-truncated triangular shaped base member having two elongated apertures for receiving the two mounting lobes of the hydraulic cylinder assembly, the mounting lobes extending through the elongated apertures when assembled, and three vertical support members attached to the end-truncated triangular shaped base member at about 120 degrees apart with respect to each other;

one of the three vertical support members having an aperture adapted to be collinear with the apertures of the two mounting lobes of the hydraulic cylinder assembly and fitting within the elongated apertures of the end-truncated triangular shaped base member;

whereby a pin is configured to be extended through the apertures of each of the two mounting lobes and the vertical support member to removably attach the mounting bracket to the hydraulic cylinder assembly;

whereby the extraction tool lifting apparatus is configured to be removably connected to said extraction tool for removal of an object embedded within a confinement; and further whereby the extraction tool lifting apparatus is configured to be disassembled when not in use.

2. The system of claim 1, wherein the load bearing coupling further comprises: a kelly bar adapter.

3. The system of claim 1, wherein the load bearing coupling further comprises: an extraction ring having a first end adapted to be removably connected to the second end of the elongated base member of the extraction tool, and a second end of the extraction ring having a substantially ring shape.

4. The system of claim 1, wherein the load bearing coupling further comprises: a rectangular cross section and a connection aperture through which a pin is configured to be inserted.

5. The system of claim 1, wherein the extraction tool lifting apparatus further comprises:

each of the three legs having cooperating first and second portions so as to be adjustable among a plurality of lengths;

whereby the extraction tool lifting apparatus is configured to be adjustable to different heights and differing ground contours.

6. The system of claim 1, wherein the extraction tool lifting apparatus further comprises:

each of the three legs having support pads pivotably connected to a second end of each leg;

whereby each pad is configured to be orbitally adjustable;

whereby the legs are configured to be restrained from sinking into a ground surface.

7. The system of claim 1, wherein the extraction tool lifting apparatus further comprises:

restraining means operatively connected to all of the legs proximate second ends thereof;

whereby the legs are configured to be selectively restrained from outward extension.

8. The system of claim 7, wherein the extraction tool lifting apparatus further comprises:

the restraining means comprising chain, cable, or rope.

* * * * *